US006129649A

United States Patent [19]

Yang

[11] Patent Number: 6,129,649

[45] Date of Patent: Oct. 10, 2000

[54] TRAMPOLINE HAVING A JUMPING BED WITH ELASTIC STRAPS FOR SUPPORTING THE SAME ON TRAMPOLINE FRAME

[76] Inventor: Yen-Shuo Yang, 2F-3, No. 3, Wu-Chang-Nan St., Pei Dist., Taichung City, Taiwan

[21] Appl. No.: 09/484,528

[22] Filed: Jan. 18, 2000

[51] Int. Cl.[7] ..... A63B 5/08

[52] U.S. Cl. ..... 482/27; 482/28

[58] Field of Search ..... 482/27, 28, 35; 5/110, 111; 52/99.1, 100

[56] References Cited

U.S. PATENT DOCUMENTS

| | | | |
|---|---|---|---|
| 2,991,841 | 7/1961 | Sampson et al. | 482/27 |
| 5,967,943 | 10/1999 | Rich | 482/27 |
| 5,984,837 | 3/2000 | Weaver et al. | 482/35 |
| 6,036,620 | 3/2000 | Yang | 482/28 |

*Primary Examiner*—Stephen R. Crow
*Attorney, Agent, or Firm*—Baker Botts L.L.P.

[57] ABSTRACT

A trampoline includes a trampoline frame with a leg portion and a looped frame portion mounted on the leg portion. A jumping bed includes a bed member with a dimension smaller than that of a bed mounting space confined by the looped frame portion. An elastic support unit has a plurality of folded elastic straps, each with opposite hooking ends secured to a peripheral portion of the bed member and an intermediate section confining a passage for extension of the looped frame portion therethrough, thereby suspending elastically the bed member relative to the looped frame portion. A looped protective covering has an upper covering portion with an inner peripheral section secured to an upper surface of the peripheral portion of the bed member, and an outer peripheral section that extends above the looped frame portion so as to be disposed outwardly and laterally of the looped frame portion. The protective covering further has a lower covering portion that extends from the outer peripheral section of the upper covering portion and that has an inner peripheral section extending below the looped frame portion, and a looped elastic band secured on the inner peripheral section of the lower covering portion.

5 Claims, 9 Drawing Sheets

TRAMPOLINE HAVING A JUMPING BED WITH ELASTIC STRAPS FOR SUPPORTING THE SAME ON TRAMPOLINE FRAME

FIELD OF THE INVENTION

The invention relates to a trampoline, more particularly to a trampoline having a jumping bed with elastic straps for supporting the same on a trampoline frame.

BACKGROUND OF THE INVENTION

Referring to FIGS. 1 and 2, a conventional trampoline includes a trampoline frame 10, a jumping bed 11, and a plurality of coil springs 12.

As illustrated, the trampoline frame 10 includes a leg portion having a plurality of upright legs 101 adapted to be disposed uprightly on a ground surface, and a looped frame portion 103 mounted on top of the legs 101 so as to be supported spacedly from and parallel to the ground surface. The looped frame portion 103 confines a bed mounting space 104 therewithin.

The jumping bed 11 includes a bed member 111 with a peripheral portion 112 and of a dimension smaller than that of the bed mounting space 104. Each of the coil springs 12 has an inner end 121 hooked on the peripheral portion 112 of the bed member 111, and an outer end 122 hooked on the looped frame portion 103, thereby suspending resiliently the bed member 111 relative to the looped frame portion 103.

In order to prevent the jumper's feet from slipping into a clearance 106 formed between an adjacent pair of the springs 12 and between the peripheral portion 112 of the bed member 111 and the looped frame portion 103, an annular protective covering 14 (see FIG. 2) is disposed on the looped frame portion 103 so as to cover the clearances 106. The protective covering 14 has an anchoring portion 140 engaging the looped frame portion 103 and an inner covering portion 141 that extends radially and inwardly from the anchoring portion 140 so as to be disposed above and cover the clearances 106.

A disadvantage that results from the use of the conventional trampoline is that, the inner covering portion 141 of the protective covering 14 will separate from the bed member 111 during a jumping operation on the latter due to the lack of a securing mechanism therebetween, thereby resulting in a clearance between the inner covering portion 141 and the bed member 111 via which the jumper's feet can drop thereinto and thus lead to possible injury due to contact with the inner ends 121 of the springs 12.

SUMMARY OF THE INVENTION

Therefore, the object of this invention is to provide a trampoline having a jumping bed with elastic straps for supporting the same on a trampoline frame and which is capable of overcoming the aforesaid disadvantage that generally results from the use of the conventional trampoline.

Accordingly, a trampoline of this invention includes a trampoline frame and a jumping bed. The trampoline frame includes a leg portion disposed uprightly on a ground surface, and a looped frame portion mounted on top of the leg portion so as to be supported spacedly from and parallel to the ground surface. The looped frame portion confines a bed mounting space therewithin. The jumping bed includes a bed member with a peripheral portion and of a dimension smaller than that of the bed mounting space, and an elastic support unit that has a plurality of folded elastic straps. Each of the elastic straps has opposite hooking ends secured to the peripheral portion of the bed member and an intermediate section confining a passage for extension of the looped frame portion therethrough, thereby suspending elastically the bed member relative to the looped frame portion. A looped protective covering has an upper covering portion with an inner peripheral section secured to an upper surface of the peripheral portion of the bed member, and an outer peripheral section that extends above the looped frame portion so as to be disposed outwardly and laterally of the looped frame portion. The protective covering further has a lower covering portion that extends from the outer peripheral section of the upper covering portion and that has an inner peripheral section extending below the looped frame portion, and a looped elastic band secured on the inner peripheral section of the lower covering portion such that the inner peripheral section of the lower covering portion is anchored elastically on the looped frame portion.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
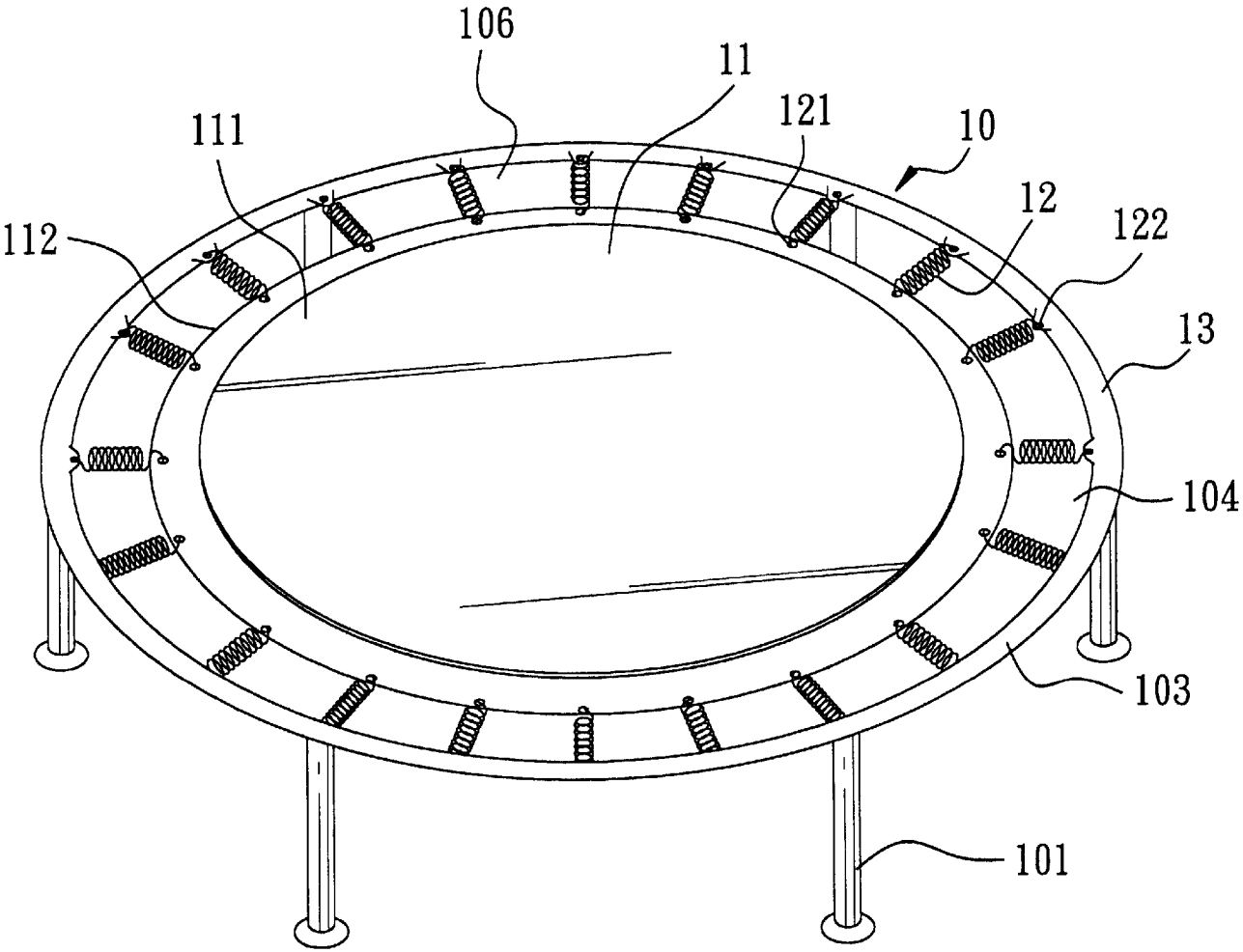
FIG. 1 PRIOR ART
FIG. 1 is a perspective view of a conventional trampoline in which a protective covering is removed for the sake of clarity.
Figure 2:
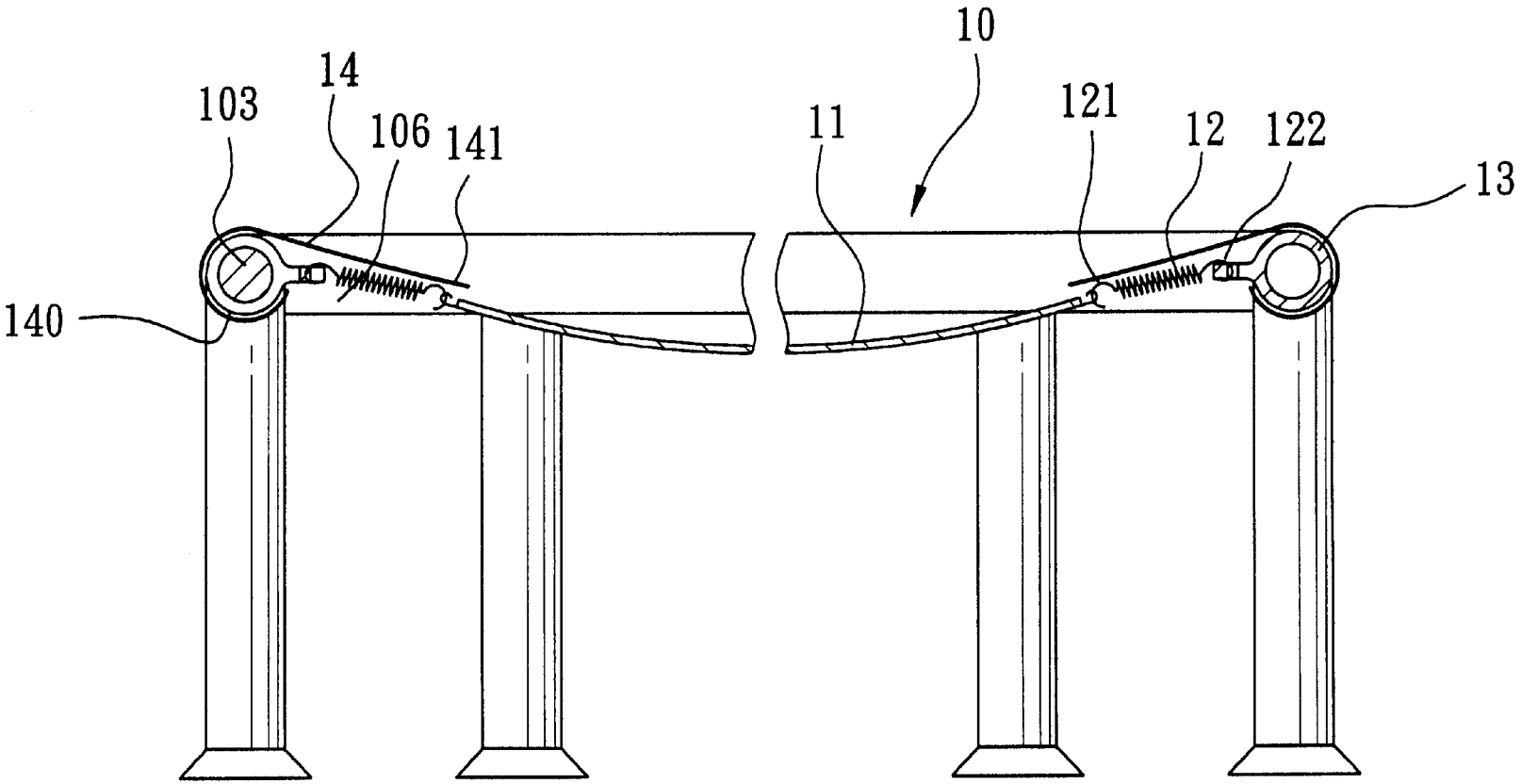
FIG. 2 PRIOR ART
FIG. 2 is a partly sectional view of the conventional trampoline.
Figure 3:
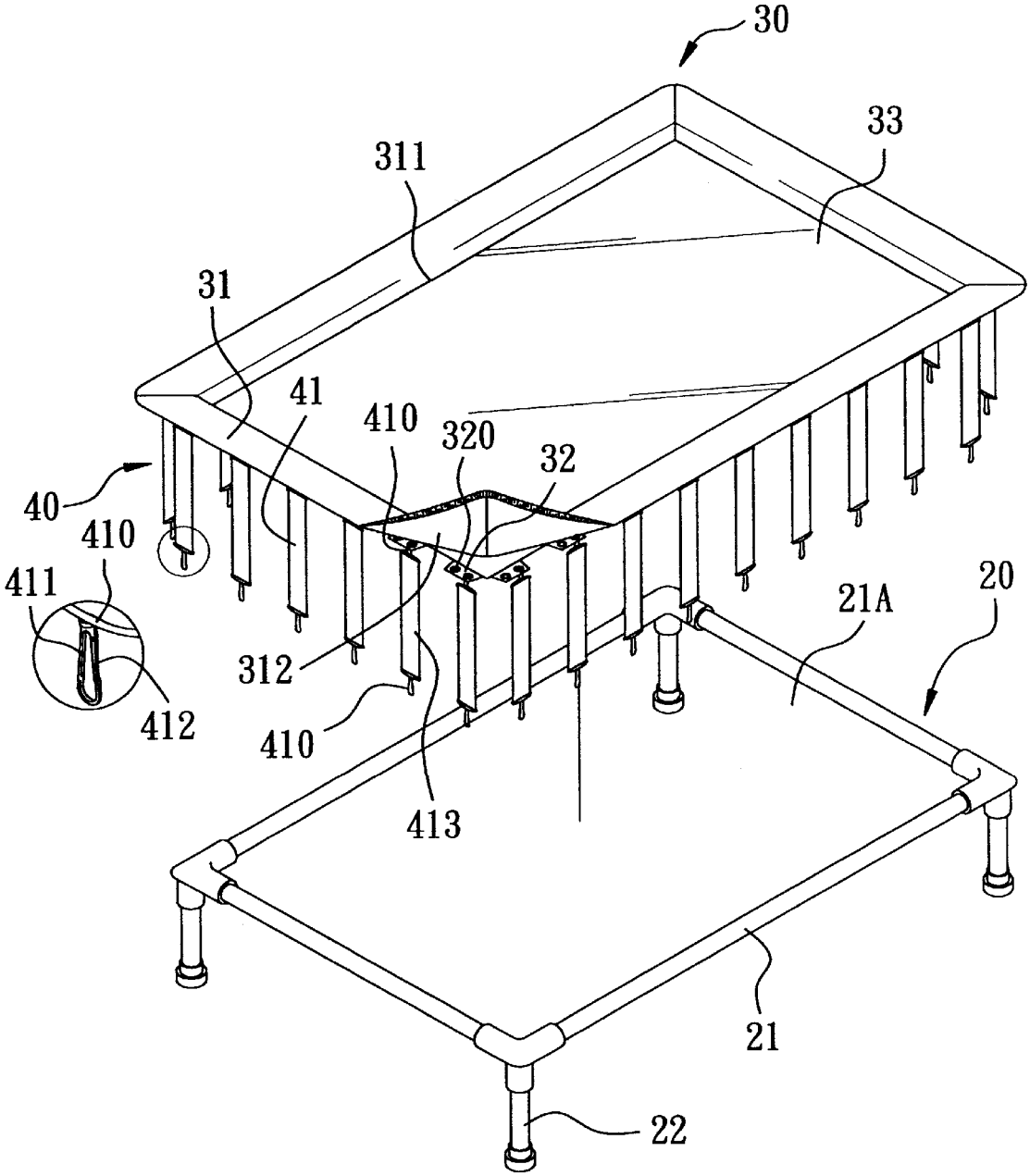
FIG. 3 is a partly exploded view of a preferred embodiment of a trampoline according to this invention.
Figure 4:
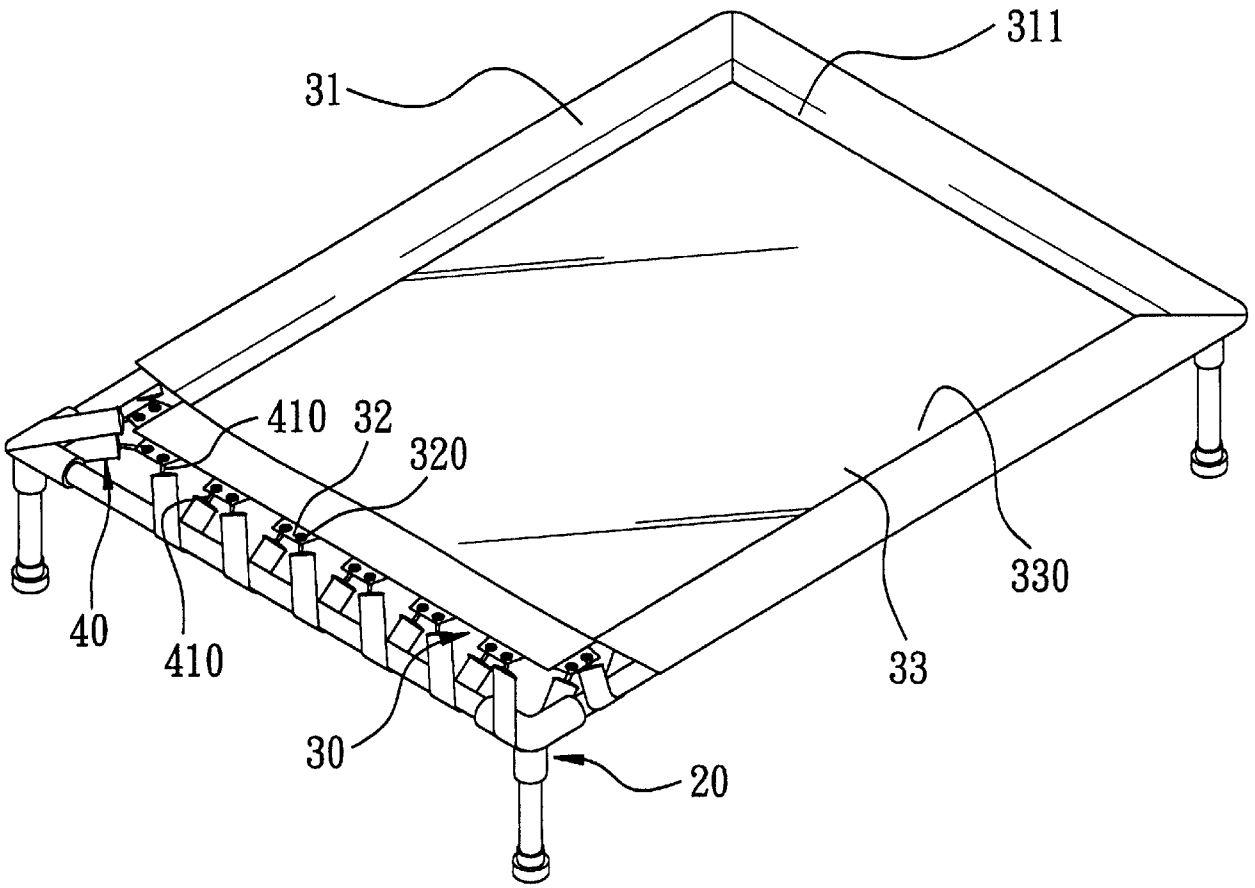
FIG. 4 is an assembled perspective view of the preferred embodiment.
Figure 5:
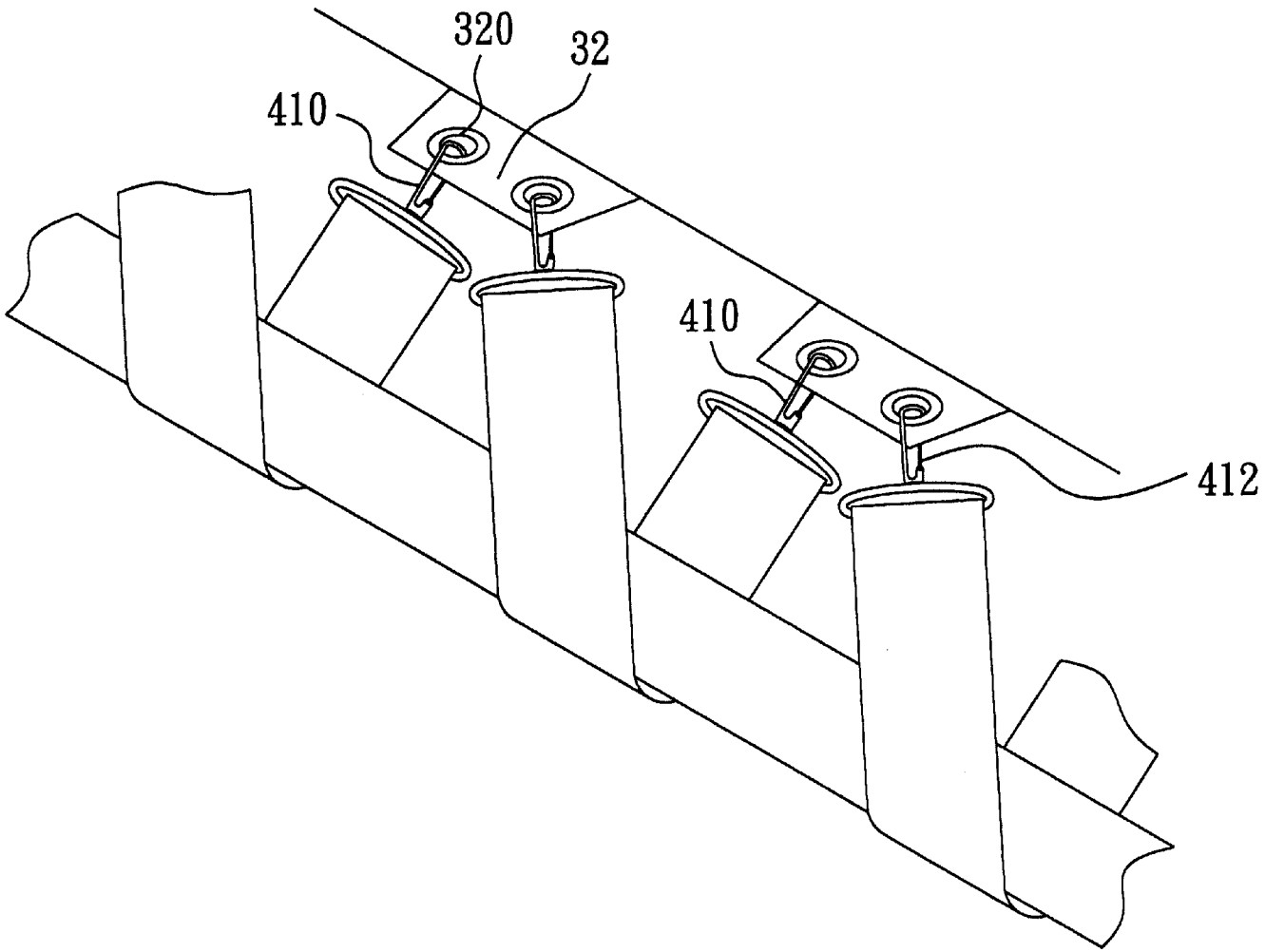
FIG. 5 is an enlarged fragmentary perspective view of the preferred embodiment.
Figure 6:
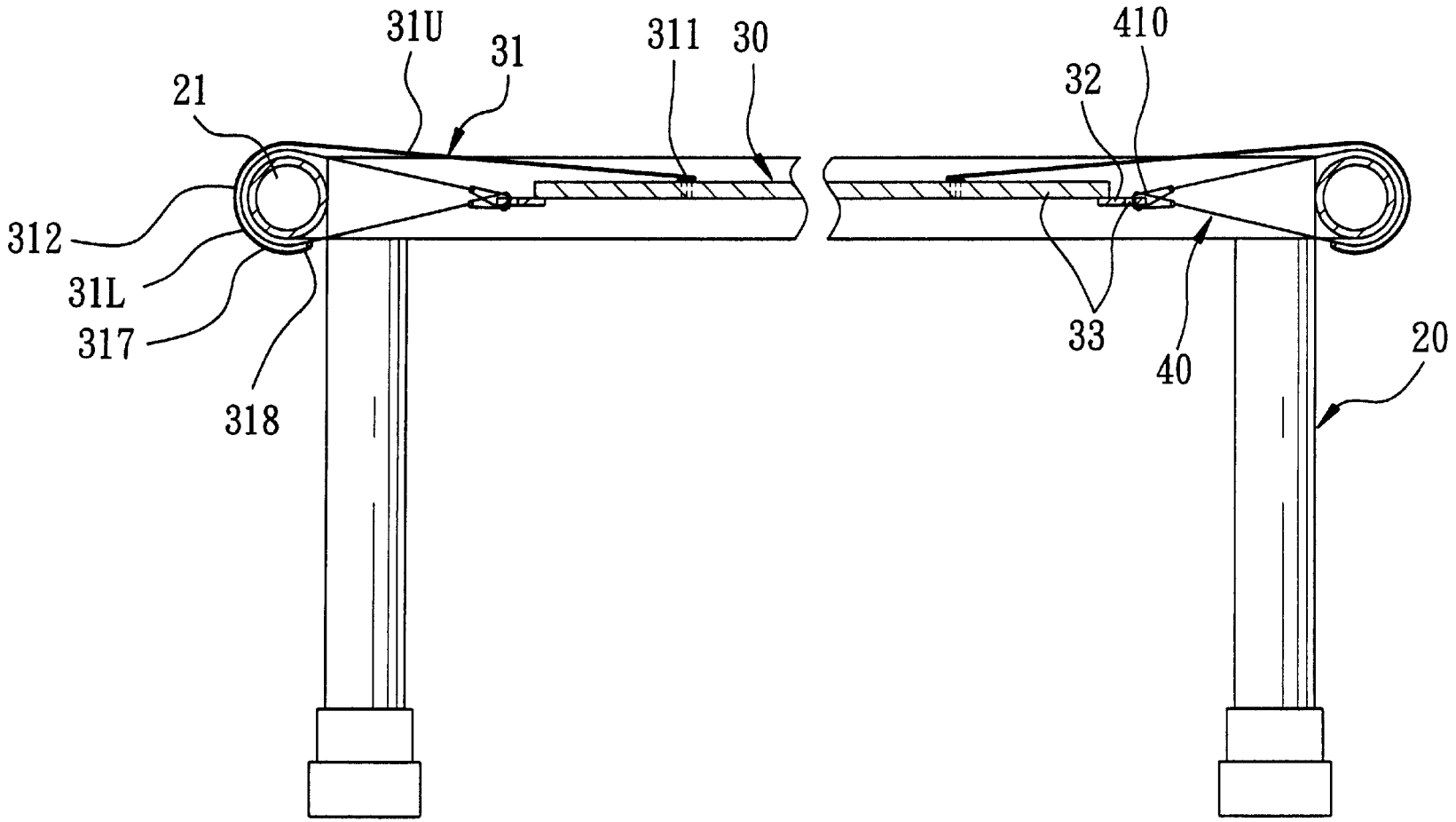
FIG. 6 is a partly sectional view of the preferred embodiment.

Before the present invention is described in greater detail, it should be noted that the same numerals will be used to denote the same elements through out the specification.

Referring to FIGS. 3, 4, 5 and 6, the preferred embodiment of a trampoline 20 according to the present invention is shown to include a trampoline frame 20 and a jumping bed 30.

As illustrated, the trampoline frame 20 includes leg portion having a plurality of legs 22 adapted to be disposed uprightly on a ground surface, and a looped frame portion 21 mounted on top of the legs 23 so as to be supported spacedly from and parallel to the ground surface. The looped frame portion 21 confines a bed mounting space 21A therwithin.

The jumping bed 30 includes a bed member 33 with a peripheral portion 330 and of a dimension smaller than that of the bed mounting space 21A. The jumping bed 30 further includes an elastic support unit 40 that has a plurality of folded elastic straps 41. Each of the elastic straps 41 has opposite hooking ends 410 secured to the peripheral portion 330 of the bed member 33 and an intermediate section 413 that confines a passage for extension of the looped frame portion 21 therethrough (see FIG. 4). Thus, the bed member 33 is suspended elastically relative to the looped frame portion 21. Preferably, the looped frame portion 21 and the bed member 33 are rectangular in shape, and the elastic straps 41 are arranged spacedly on four side of the bed member 33.

A looped protective covering 31 has an upper covering portion (31U) with an inner peripheral section 311 secured to an upper surface of the peripheral portion 330 of the bed member 33, and an outer peripheral section 312 that extends above the looped frame portion 21 (see FIG. 6) so as to be disposed outwardly and laterally of the looped frame portion 21. The protective covering 31 further has a lower covering portion (31L) that extends from the outer peripheral section 312 of the upper covering portion (31U) and that has an inner peripheral section 317 extending below the looped frame portion 21, and a looped elastic band 318 secured on the inner peripheral section 317 of the lower covering portion (31L) such that the inner peripheral section 317 of the lower covering portion (31L) is anchored elastically on the looped frame portion 21. Preferably, the protective covering 31 is made of a flexible material.

The peripheral portion 330 of the bed member 33 has a plurality of spaced apart hook-engaging tabs 32 attached thereto, such as by sewing. The hooking ends 410 of the elastic straps 41 are hooked to the hook-engaging tabs 32. In the preferred embodiment, each of the hook-engaging tabs 32 has a pair of eyelets 320 provided thereon. The hooking ends 410 of each of the elastic straps 41 are hooked to an adjacent pair of the eyelets 320 in an adjacent pair of the hook-engaging tabs 32 (see FIG. 5). Each of the hooking ends 410 is provided by a stationary hook part 411 and a movable hook part 412 which cooperate to define an openable ring fastener.

Figure 7:
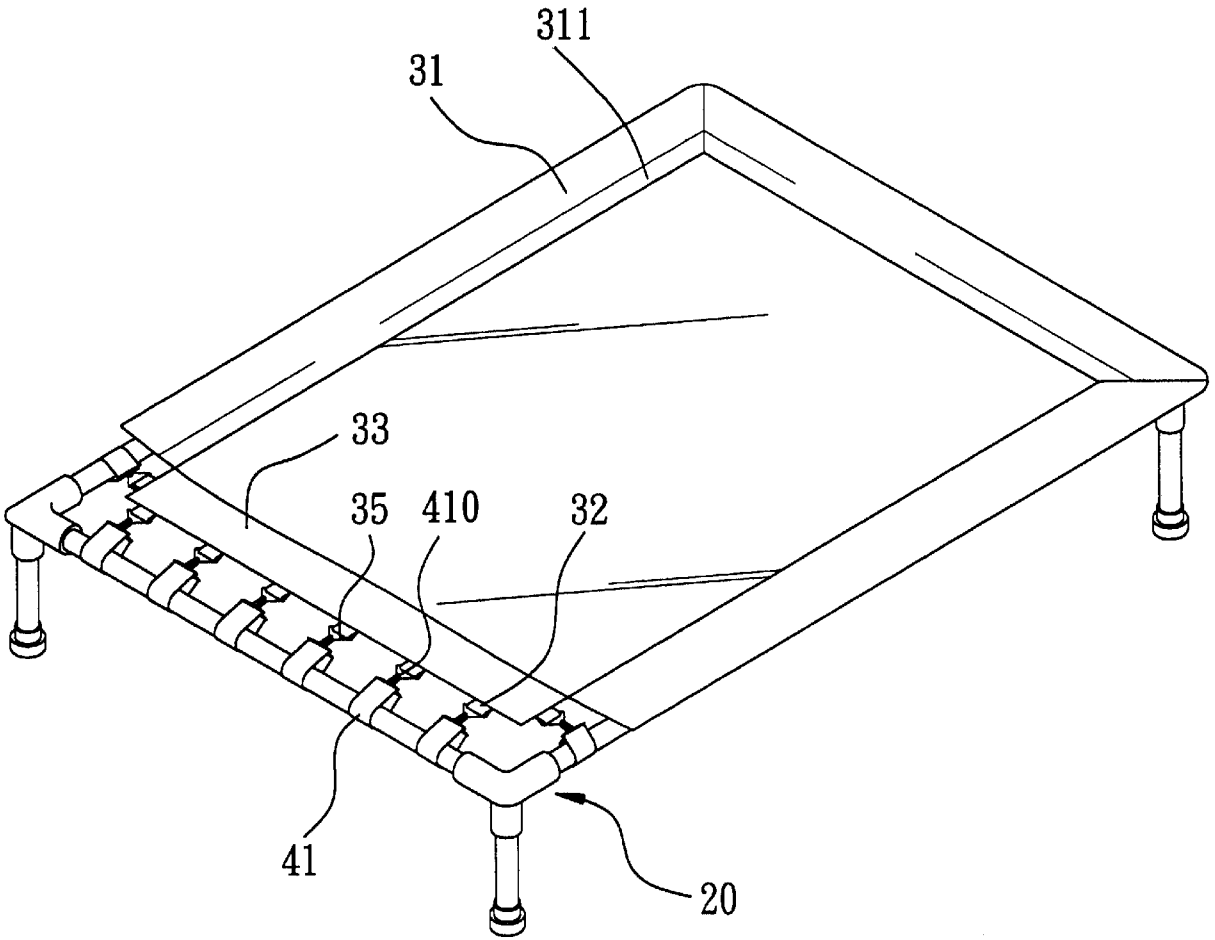
FIG. 7 is a perspective view of a second preferred embodiment of the present invention.

FIG. 7 shows a second preferred embodiment which is similar to the previous embodiment in structure except that each of the hook-engaging tabs 32 is provided with a ring fastener 35 for engaging the hooking ends 410 of a respective one of the elastic straps 41.

Figure 8:
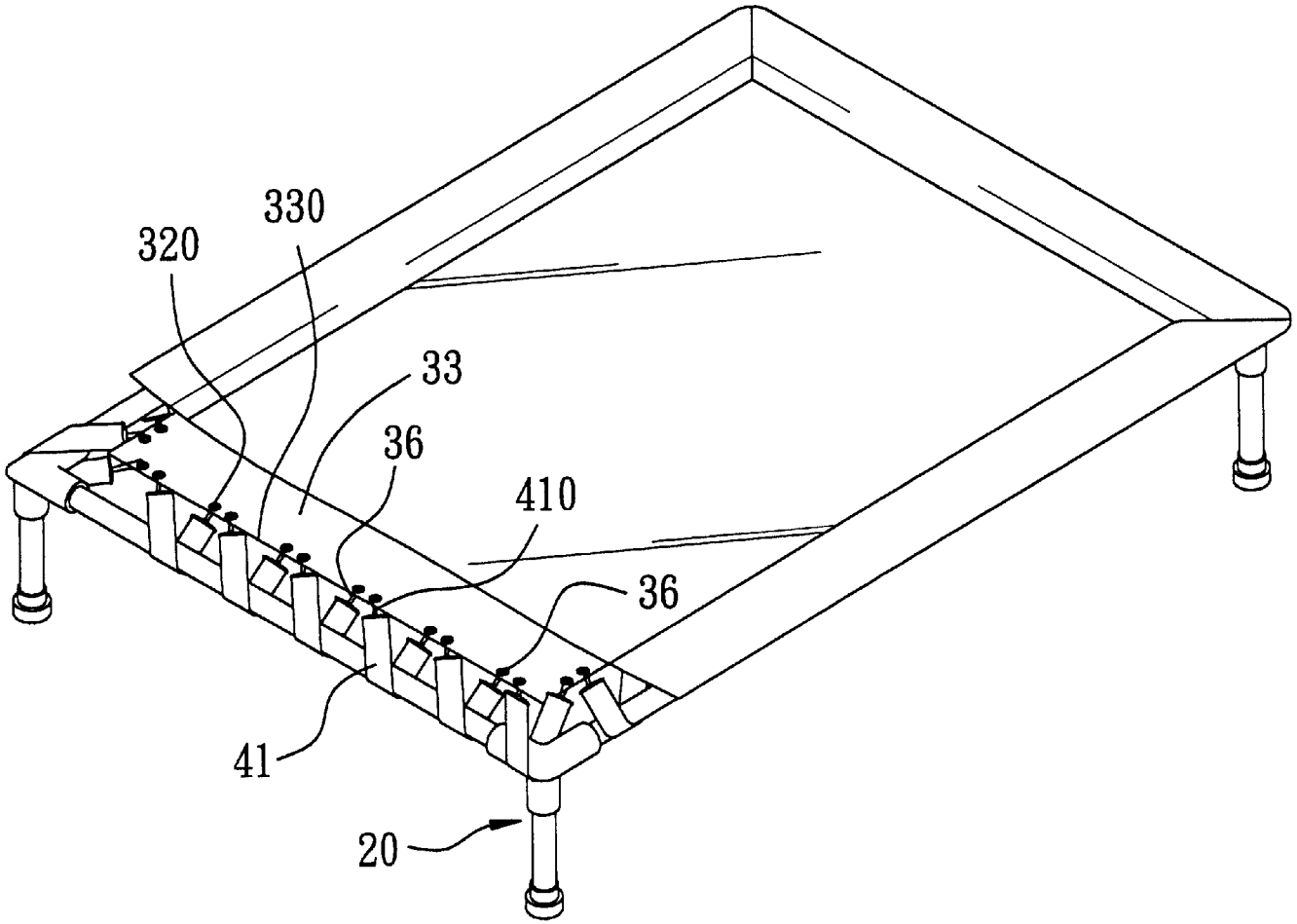
FIG. 8 is a perspective view of a third preferred embodiment of the present invention.

In a third preferred embodiment, as shown in FIG. 8, the peripheral portion 330 of the bed member 33 is provided with a plurality of eyelets 320 therealong. Thus, the hooking ends 410 of each of the elastic straps 41 can be hooked to an adjacent pair of the eyelets 320.

Figure 9:
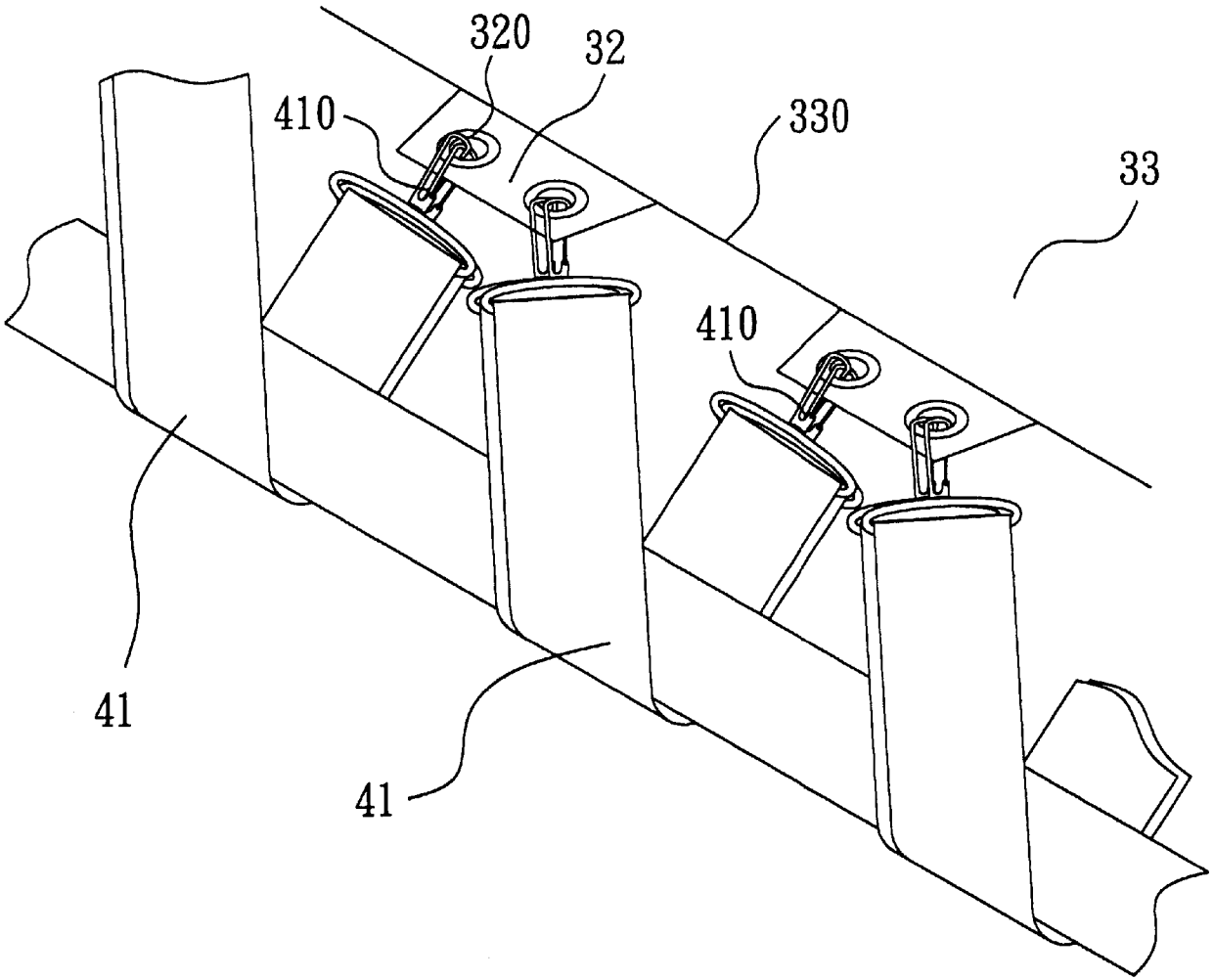
FIG. 9 is an enlarged fragmentary perspective view of a fourth preferred embodiment of the present invention.

In order to adjust elasticity of the jumping bed 30, two or more elastic straps 41 can be superimposed, and the hooking ends 410 of the superimposed elastic straps 41 can be hooked to an adjacent pair of the eyelets 320 in an adjacent pair of the hook-engaging tabs 32 that are attached to the peripheral portion 330 of the bed member 33, as best shown in FIG. 9.

Since elastic straps 41 are used instead of coil springs to suspend the bed member 33 relative to the looped frame portion 21, and since the protective covering 31 can be sewn to the bed member 33 to shield the clearances formed between adjacent ones of the folded elastic straps 41, the disadvantage that results from the use of the conventional trampoline can be avoided.

With this invention thus explained, it is apparent that numerous modifications and variations can be made without departing from the scope and spirit of this invention. It is therefore intended that this invention be limited only as indicated in the appended claims.

What is claimed is:

1. A trampoline comprising:

a trampoline frame including a leg portion adapted to be disposed uprightly on a ground surface, and a looped frame portion mounted on top of said leg portion so as to be supported spacedly from and parallel to the ground surface, said looped frame portion confining a bed mounting space therewithin; and a jumping bed including a bed member with a peripheral portion and of a dimension smaller than that of said bed mounting space, an elastic support unit having a plurality of folded elastic straps, each of said elastic straps having opposite hooking ends secured to said peripheral portion of said bed member and an intermediate section confining a passage for extension of said looped frame portion therethrough, thereby suspending elastically said bed member relative to said looped frame portion, and a looped protective covering having an upper covering portion with an inner peripheral section secured to an upper surface of said peripheral portion of said bed member, and an outer peripheral section that extends above said looped frame portion so as to be disposed outwardly and laterally of said looped frame portion, said protective covering further having a lower covering portion that extend from said outer peripheral section of said upper covering portion and that has an inner peripheral section extending below said looped frame portion, and a looped elastic band secured on said inner peripheral section of said lower covering portion such that said inner peripheral section of said lower covering portion is anchored elastically on said looped frame portion.

2. The trampoline as defined in claim 1, wherein said peripheral portion of said bed member has a plurality of spaced apart hook-engaging tabs attached thereto, said hooking ends of said elastic straps being hooked to said hook-engaging tabs.

3. The trampoline as defined in claim 2, wherein each of said hook-engaging tabs has a pair of eyelets provided thereon, said hooking ends of each of said elastic straps being hooked to an adjacent pair of said eyelets in an adjacent pair of said hook-engaging tabs.

4. The trampoline as defined in claim 2, wherein each of said hook-engaging tabs is provided with a ring fastener for engaging said hooking ends of a respective one of said elastic straps.

5. The trampoline as defined in claim 1, wherein said peripheral portion of said bed member is provided with a plurality of eyelets therealong, said hooking ends of each of said elastic straps being hooked to an adjacent pair of said eyelets.

* * * * *